US008350680B2

(12) United States Patent
Cole et al.

(10) Patent No.: US 8,350,680 B2
(45) Date of Patent: Jan. 8, 2013

(54) SYSTEM FOR MAINTAINING ELECTRICALLY OPERATED FOLDING PARTITION SYSTEMS

(76) Inventors: Stephen F. Cole, Great River, NY (US); Kathleen Cole, Great River, NY (US)

( * ) Notice: Subject to any disclaimer, the term of this patent is extended or adjusted under 35 U.S.C. 154(b) by 313 days.

(21) Appl. No.: 12/788,758

(22) Filed: May 27, 2010

(65) Prior Publication Data

US 2010/0300628 A1 Dec. 2, 2010

Related U.S. Application Data

(60) Provisional application No. 61/217,081, filed on May 27, 2009.

(51) Int. Cl.
*G08B 1/00* (2006.01)

(52) U.S. Cl. ..... 340/309.16; 340/540; 340/541; 340/573.1; 340/573.4; 340/5.81; 340/5.82; 340/5.83; 340/545.4; 340/545.8; 187/247; 187/391; 187/395; 187/397

(58) Field of Classification Search ..... 340/309.16, 340/540, 541, 573.1, 573.4, 5.81–5.83, 545.4, 340/545.8; 187/247, 391, 395, 397
See application file for complete search history.

(56) References Cited

U.S. PATENT DOCUMENTS

| | | | | |
|---|---|---|---|---|
| 4,719,363 | A * | 1/1988 | Gallacher | 307/117 |
| 5,152,332 | A * | 10/1992 | Siener | 160/188 |
| 5,244,030 | A | 9/1993 | Cole et al. | |
| 6,060,969 | A | 5/2000 | Hufgard et al. | |
| 7,002,442 | B2 | 2/2006 | Mandell et al. | |
| 8,041,977 | B2 * | 10/2011 | Lin et al. | 713/340 |

* cited by examiner

*Primary Examiner* — Tai T Nguyen
(74) *Attorney, Agent, or Firm* — Sorell, Lenna & Schmidt, LLP

(57) ABSTRACT

A system for maintaining an electrically operated folding wall comprising: (a) a maintenance detecting means; (b) a time measuring means; (c) a first time alarm means for detecting a preset time for a maintenance reminder; (d) a second time alarm means far detecting a preset time for maintenance; (e) a first maintenance schedule indicator for indicating that maintenance is soon required; f) a second maintenance schedule indicator for indicating that maintenance is required; (g) a preventing means for preventing the electrical operation circuit of the folding operable wall from functioning after the second time alarm detects that the time measuring means has reached the preset time for maintenance; (h) a resetting means for resetting the time measured by the time measuring means after the required maintenance has been performed; and (i) a restarting means for restarting the electrical operation circuit of the folding operable wall after the required service has been performed.

20 Claims, 3 Drawing Sheets

SYSTEM FOR MAINTAINING ELECTRICALLY OPERATED FOLDING PARTITION SYSTEMS

CROSS REFERENCE TO RELATED APPLICATIONS

This application claims priority to U.S. Provisional Application No. 61/217,081 filed May 27, 2009, which is herein incorporated by reference in its entirety.

TECHNICAL FIELD

The present disclosure generally relates to electrically operated folding partitions, and more particularly to a system for maintaining an electrically operated folding partition system.

BACKGROUND

Portable folding partitions or walls having a plurality of vertically oriented panels have conventionally been used to provide temporary walls to, for example, divide off two or more areas of a given room. In particular, folding portable partitions provide a quick and efficient means to divide large open rooms, such as a school gymnasium, auditorium, cafeteria or classroom into smaller areas. The vertically oriented panels are suspended from a horizontal rail system along which the panels are movable. In order to facilitate movement of the portable folding partitions, casters or wheels may be used, which allow the portable partition to be easily positioned to the desired location, and then rolled back into its storage area for later use.

Portable folding partitions have been adapted to include mechanisms which open and close the moving partitions automatically by an electrical system. However, due to the large amount of force needed to move the weight of the folding partitions, electrically operated folding partitions can cause injury, or even death, to a person who accidentally becomes trapped between the partitions.

Electrically operated folding partitions, like any other mechanical apparatus, need to be maintained over time to function safely and efficiently. Indeed, recognizing the importance of routine and periodic maintenance for electrically operated folding partitions, many states have enacted laws requiring schools to maintain electrically operated folding partitions in accordance with the manufacturer's instructions, including the manufacturer's recommended service interval.

However, conventional electrically operated folding operable walls lack a means to indicate what maintenance is required on electrically operated folding operable walls, and when such maintenance is required. Indeed, conventional electrically operated folding operable walls fail to notify the individual(s) responsible for maintaining the same what maintenance is required, and when such maintenance is required, therefore creating the possibility that that routine and periodic maintenance will be easily overlooked. Furthermore, electrically operated folding partitions which have not been properly maintained, perhaps unbeknownst to the operator thereof, may nevertheless be operated, thereby creating a dangerous situation. Indeed, electrically operated folding partitions which have not been properly maintained may, for example, fail to detect an object, such as a person, in the path of the folding operable wall, and hence stop, thus increasing the likelihood that a person will accidentally become trapped between the partitions, even if the operator of electrically operated folding partition is attentive. It is important that only properly trained personnel be permitted access to the folding partition system for maintenance and operation.

Moreover, conventional electrically operated folding partitions do not provide any means to validate if a particular electrically operated folding partition has been maintained in accordance with the manufacturer's instructions. Accordingly, electrically operated folding partitions which have not been properly maintained, perhaps unbeknownst to the user thereof, may nevertheless be operated, thereby creating an undue risk of accident. Conventional electrically operated folding partitions also fail to utilize a system for maintaining the electrically operated folding partition that ensures that the electrically operated folding partition is maintained in accordance with the manufacturer's instructions by providing a means which renders the electrically operated folding partition inoperable unless the electrically operated folding partition is maintained in accordance with the manufacturer's instructions.

Therefore, it would be desirable if an electrically operated folding operable wall included a means to indicate what maintenance is required, and when. It would also be desirable if an electrically operated folding wall was prevented from functioning if it is determined that the electrically operated folding operable wall has not been maintained in accordance with the manufacturers instructions. It is also desirable that the system permits access only to personnel who have been designated as having the proper training for maintenance or operation of the system.

SUMMARY OF THE INVENTION

Accordingly, the present disclosure provides an electrically operated folding operable wall system which includes a means to indicate what maintenance is required on the electrically operated folding operable wall, and when such maintenance is required. Desirably, the electrically operated folding partition system prevents the electrically operated folding operable wall from functioning if it is determined that the electrically operated folding operable wall has not been maintained in accordance with the manufacturer's instructions.

In one embodiment, an electrically operated folding operable wall is provided which is controlled by an electrical operation circuit of the type having at least one control station, an extend control switch, a stack control switch, control relays and a motor. However, it is understood that the system of the present invention may be utilized in connection with electrically operated folding operable walls in which the extend control switch and the stack control switch is replaced by key switch having a first position and a second position, which is used to stack and extend the electrically operated folding operable wall, respectively.

In particular, the present invention involves a safety system which includes a maintenance detecting means electrically connected to the control station of the electrical operation circuit for detecting what maintenance has been performed on the electrically operated folding operable wall, as well as when such maintenance was performed.

A time measuring means is electrically connected between the control station of the electrical operation circuit and the maintenance detecting means for measuring the time since the electrically operated folding operable wall was last serviced, based on information received from the maintenance detecting means.

A first time alarm means is electrically connected between the control station of the electrical operation circuit and the time measuring means for detecting when the time measured by the time measuring means has reached a preset time for a maintenance reminder.

A second time alarm means is electrically connected between the control station of the electrical operation circuit and the time measuring means for detecting when the time measured by the time measuring means has reached a preset time for maintenance.

A first maintenance schedule display control means is electrically connected between the control station of the electrical operation circuit and the first time alarm means for generating and displaying a warning indicating that maintenance is soon required on a display means when the first time alarm means detects that the time the electrically operated folding operable wall was last serviced has reached the preset time for a maintenance reminder.

A second maintenance schedule display means is electrically connected between the control station of the electrical operation circuit and the second time alarm means for generating and displaying an instruction indicating that maintenance is required on the display means when the second time alarm means detects that the time the electrically operated folding operable wall was last serviced has reached the preset time for maintenance.

If and when the maintenance detecting means detects that the required maintenance has been performed, the maintenance detecting means will cancel both the warning indicating that maintenance is soon required on the first maintenance schedule display control means, and the instruction indicating that maintenance is required on the second maintenance schedule display control means.

A preventing means is provided for preventing the electrical operation circuit of the folding operable wall from functioning after the second time alarm detects that the time measuring means has reached the preset time for maintenance. In particular, the preventing means includes at least one control unit electrically connected between each control station of the electrical operation circuit and the second time alarm means, which will prevent the control unit from functioning if the second time alarm detects that the time measuring means has reached the preset time for maintenance.

A resetting means is electrically connected between the control station of the electrical operation circuit and the maintenance detecting means for resetting the time measured by the time measuring means, when the maintenance detecting means detects that the required maintenance has been performed.

A restarting means is provided for restarting the electrical operation circuit of the folding operable wall after the maintenance detecting means detects that required service has been performed. In particular, the restarting means includes a reset control key switch in the at least one control unit, which when turned on will reactivate the electrical operation circuit.

BRIEF DESCRIPTION OF THE DRAWINGS

The features of the present disclosure will become more readily apparent from the specific description accompanied by the following drawings, in which.

Like reference numerals indicate similar parts throughout the figures.

DETAILED DESCRIPTION OF THE INVENTION

The exemplary embodiments of the system of the subject invention are discussed in terms of electrically operated folding walls or partitions, and more particularly to an electrically operated folding wall system which includes an authentication means. It is envisioned that the present disclosure may be employed with electrically operated folding partitions for use with gymnasiums, auditoriums, churches and other places of worship, convention centers, offices, hotels, restaurants, residences, salons, schools, and other buildings having large spaces.

All publications, patents and patent applications cited in this specification are herein incorporated by reference in their entirety as if each individual publication, patent or patent application were specifically and individually indicated to be incorporated by reference.

The following discussion includes a description of the system of the subject invention, and related components and exemplary methods of employing the system of the subject invention. Alternate embodiments are also disclosed. Reference will now be made in detail to the exemplary embodiments of the present disclosure, which are illustrated in the accompanying figures. Turning now to FIGS. 1-4, the components of a system for maintaining an electrically operated folding wall, in accordance with the principles of the present disclosure are illustrated.

Figure 1:
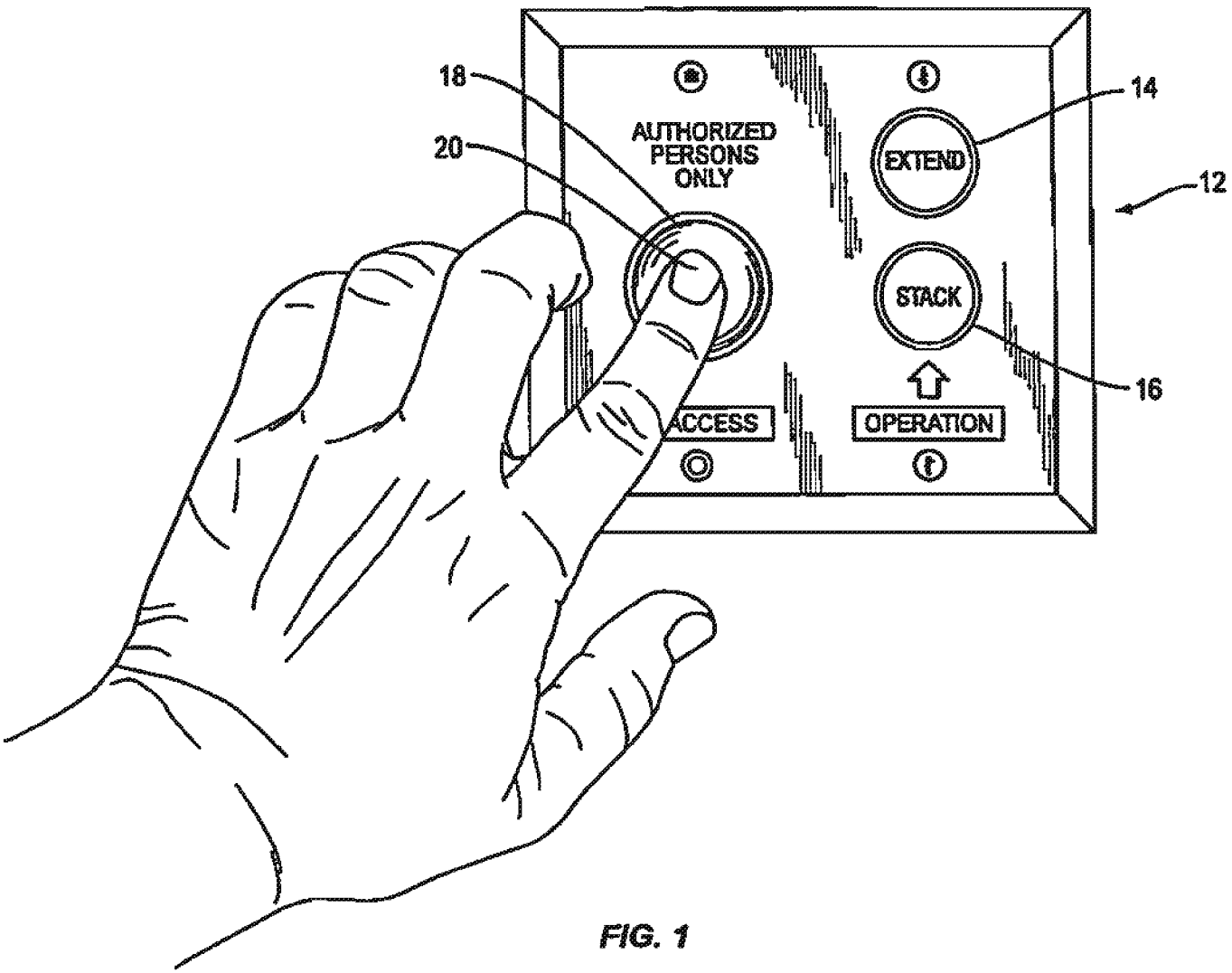
FIG. 1 is a perspective view of the control station of one embodiment of the electrically operated folding partition system in accordance with the principles of the present disclosure.
Figure 1A:
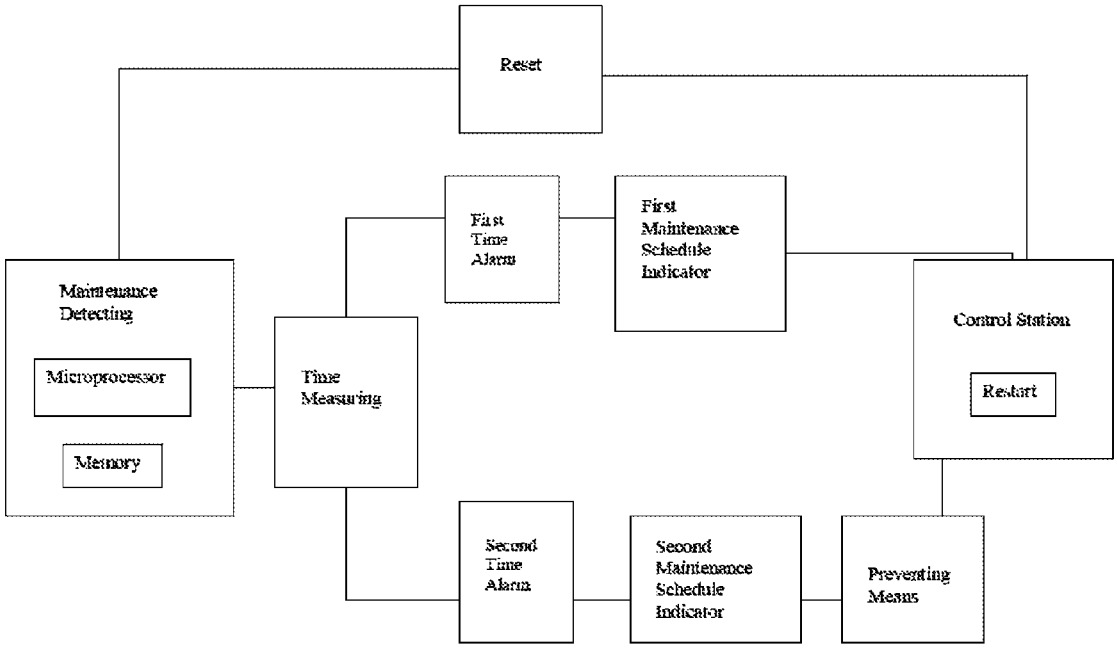
FIG. 1A is a block diagram view of a system for maintaining electrically operated folding partition systems according to the disclosure.
Figures 2, 3, 4:
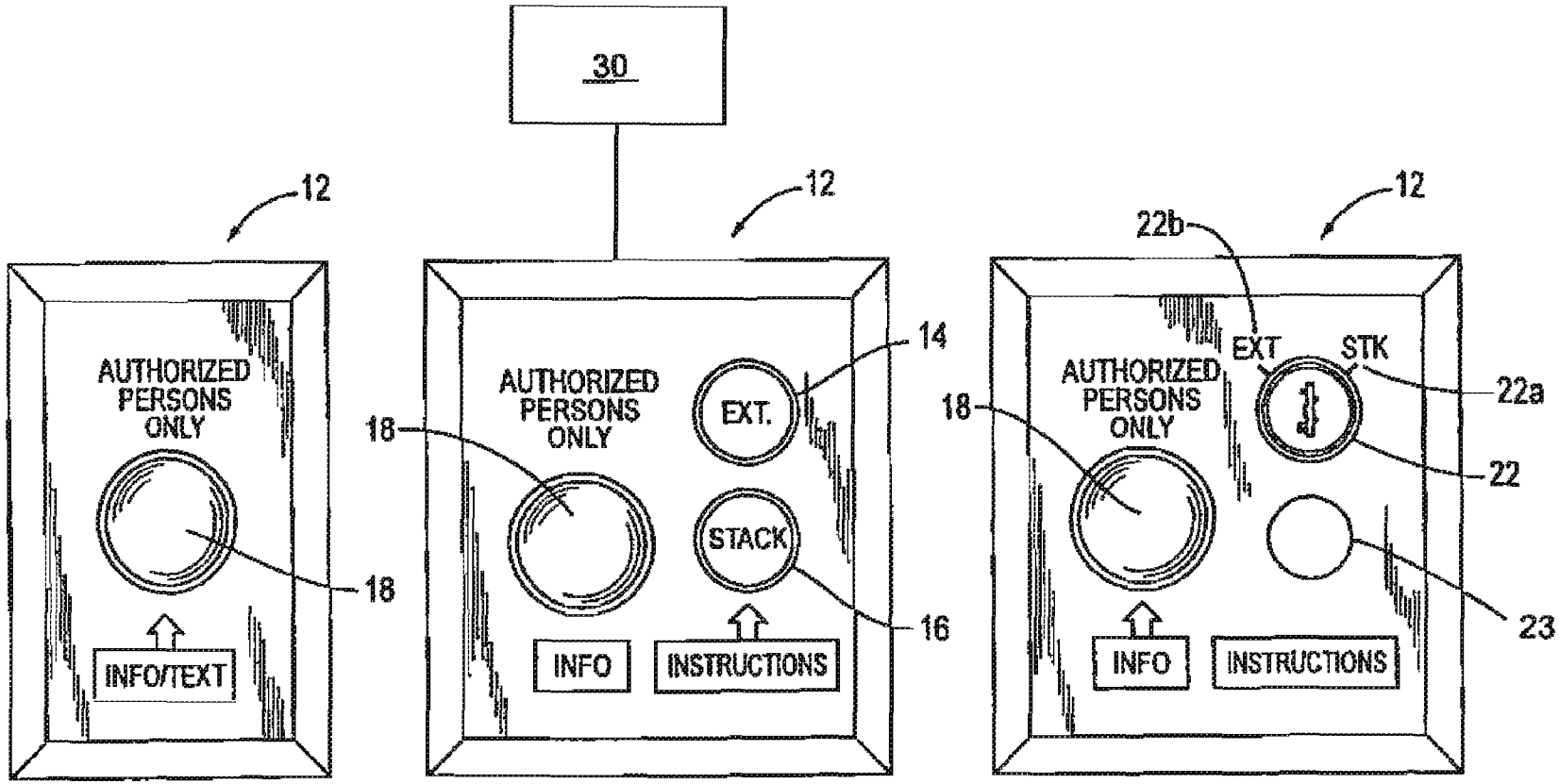
FIG. 2 is a perspective view of the control station of one particular embodiment of the electrically operated folding partition system in accordance with the principles of the present disclosure.
FIG. 3 is a perspective view of the control station of another embodiment of the electrically operated folding partition system in accordance with the principles of the present disclosure.
FIG. 4 is a perspective view of the control station of yet another embodiment of the electrically operated folding partition system in accordance with the principles of the present disclosure.

The present disclosure provides a system for maintaining electrically operated folding operable walls. The system of the present invention may be utilized in connection with electrically operated folding operable walls which are controlled by at least one control station 12 having an extend control switch 14, a stack control switch 16, control relays and a motor. However, it is understood as shown in FIG. 4 that the system of the present invention may be utilized in connection with electrically operated folding operable walls in which extend control switch 14 and stack control switch 16 is replaced by key switch 22 having a first position 22*a* and a second position 22*b*, which is used to stack and extend the electrically operated folding operable wall, respectively. Preferably, the system includes a biometric verification system such as a finger print scanner 18 which limits the operation of the system to an authorized individual who accesses the system by touching the fingerprint scanner 18 with his/her finger 20, as shown in FIG. 1. Switch 23 is a tamper resistant push button switch for actuation by the finger of a human operator for operation and control as described above in connection with extend control switch 14 and stack control switch 16.

In particular, the present invention involves a safety system which includes a maintenance detecting means electrically connected to control station 12 of the electrical operation circuit for detecting what maintenance has been performed on the electrically operated folding operable wall, as well as when such maintenance was performed. It is envisioned that the maintenance detecting means may include sensors electrically connected between control station 12 of the electrical operation circuit and the maintenance detecting means which are themselves electrically connected to various components of the electrically operated folding operable wall, to detect if each component has been properly maintained, in accordance with the manufacturers instructions. In one embodiment, the maintenance detecting means includes a microprocessor unit and a memory consisting of a ROM or RAM and the like.

A time measuring means is electrically connected between control station 12 of the electrical operation circuit and the maintenance detecting means for measuring the time since the electrically operated folding operable wall was last serviced, based on information received from the maintenance detecting means. The time measuring means of the present invention may include, for example, clocks and chronometers which have both mechanical and electrical time bases. Specifically, once the sensors of the maintenance detecting means which are connected to various components of the electrically operated folding operable wall detect that each component has been properly maintained, in accordance with the manufacturers instructions, the time measuring means will begin to count time. In one embodiment, the time measuring means measures time based on a calendar. Accordingly, the time measuring means may provide information relating to date, for example, the current date.

A first time alarm means is electrically connected between control station 12 of the electrical operation circuit and the time measuring means for detecting when the time measured by the time measuring means has reached a first preset time for a maintenance reminder. In one embodiment, the first alarm means is pre-programmed to detect that the time measured by the time measuring means has reached a specific first preset time for a maintenance reminder, such as, for example, one week before maintenance is required. However, it is understood that the first alarm means may be pre-programmed to detect that the time measured by the time measuring means has reached any specific time. Moreover, it is envisioned that the first alarm means may be pre-programmed to detect that the time measured by the time measuring means has reached more than one specific first preset time in which a maintenance reminder will be provided. Accordingly, the first alarm means can be pre-programmed to provide multiple maintenance reminders before required maintenance is actually due.

In another embodiment, the first alarm means is programmable such that an individual responsible for maintaining the electrically operated folding operable walls, for example, may program the first alarm means to detect that the time measured by the time measuring means has reached a specific first preset time for a maintenance reminder, such as, for example, one day or one month before maintenance is required. However, it is understood that the first alarm means may be programmed to detect that the time measured by the time measuring means has reached any specific time. Moreover, it is envisioned that the first alarm means may be programmed to detect that the time measured by the time measuring means has reached more than one specific first preset time in which a maintenance reminder will be provided. Accordingly, the first alarm means can be programmed to provide multiple maintenance reminders before required maintenance is actually due. In one particular embodiment, a key board is electrically connected between control station 12 of the electrical operation circuit and the first alarm means, in order to enter data to program the first alarm means. In another embodiment, a touch screen is electrically connected between control station 12 of the electrical operation circuit and the first alarm means, in order to enter data to program the first alarm means.

In one embodiment, the first alarm means detects when the time measured by the time measuring means has reached a first preset time for a maintenance reminder, based on the date the electrically operated folding operable wall was last serviced/maintained. For example, first time alarm means may be programmed to provide an individual responsible for maintaining the electrically operated folding operable wall a maintenance reminder on 30 days after the electrically operated folding operable wall was last serviced/maintained. Accordingly, when time measuring means detects that 30 days have passed since the electrically operated folding operable wall was last serviced/maintained, the first time alarm means will detect that that the time measuring means has reached a first preset time for a maintenance reminder.

In another embodiment, the first alarm means detects when the time measured by the time measuring means has reached a first preset time for a maintenance reminder, based on the date. For example, first time alarm means may be programmed to provide an individual responsible for maintaining the electrically operated folding operable wall a maintenance reminder on a specific date, such as June $1^{st}$. Accordingly, when time measuring means detects that it is June $1^{st}$, the first time alarm means will detect that that the time measuring means has reached a first preset time for a maintenance reminder.

A second time alarm means is electrically connected between control station 12 of the electrical operation circuit and the time measuring means for detecting when the time measured by the time measuring means has reached a second preset time for maintenance. The second alarm means is pre-programmed by the manufacturer of the electrically operated folding operable wall, for example, to detect when the time measured by the time measuring means has reached a second preset time for maintenance, according to the manufacturer's instructions, including the manufacturers recommended service interval.

Thus, if the manufacturer's instructions require that the electrically operated folding operable wall be maintained every 3 months, for example, the second alarm means would be pre-programmed in 3 month intervals. However, it is understood that the second alarm means may be pre-programmed in intervals of any duration. Alternatively, the second alarm means may be pre-programmed, based upon the last time a specific maintenance task was performed, such as a safety inspection, for example.

In one embodiment, the second alarm means detects when the time measured by the time measuring means has reached a second preset time for maintenance, based on the date the electrically operated folding operable wall was last serviced/maintained. For example, first time alarm means may indicate that maintenance is required 30 days after the electrically operated folding operable wall was last serviced/maintained. Accordingly, when time measuring means detects that 30 days have passed since the electrically operated folding operable wall was last serviced/maintained, the second time alarm means will detect that that the time measuring means has reached a second preset time for maintenance.

In another embodiment, the second alarm means detects when the time measured by the time measuring means has reached a second preset time for maintenance, based on the date. For example, second time alarm means may be programmed to indicate that maintenance is required on a specific date, such as June 1st. Accordingly, when time measuring means detects that it is June 1st, the second time alarm means will detect that that the time measuring means has reached a second preset time for maintenance.

A first maintenance schedule indicator is electrically connected between control station 12 of the electrical operation circuit and the first time alarm means for generating and displaying a warning indicating that maintenance is soon required, when the first time alarm means detects that the time the electrically operated folding operable wall was last serviced has reached a first preset time for a maintenance reminder. As stated above, the first alarm means may be pre-programmed to detect that the time measured by the time measuring means has reached a specific first preset time for providing a maintenance reminder, such as, for example, one week before maintenance is required. Alternatively, the first alarm means may be programmed to detect that the time measured by the time measuring means has reached a specific first preset time for a maintenance reminder, such as, for example, one day or one month before maintenance is required. Accordingly, when the time measuring means has reached a specific preset time for providing a maintenance reminder, the first maintenance schedule indicator will provide a warning indicating that maintenance is soon required, when such maintenance is required, and optionally will indicate specifically the required maintenance task(s).

Referring to FIG. 3, in one embodiment of the present invention, the first maintenance schedule indicator includes an audio and/or visual alarm signal unit 30 which can be separate from, but operatively associated with, the control station 12. Or, alarm signal unit 30 can be integral with the control station 12. The alarm signal unit 30 can be, for example, a visual alarm signal unit and can include one or more light emitting diodes (LED), incandescent or fluorescent lights, or a visual display screen such as a cathode ray tube (CRT), a touch screen, or a liquid crystal display (LCD), and can generate a steady or flashing light, scrolling or steady text, and the like to visually alert an operator that maintenance will be required in a predetermined period of time. In another embodiment, the alarm signal unit 30 can be an audible alarm signal unit such as, for example, a buzzer, bell, steady or intermittent tone generator, verbal recording or the like.

A second maintenance schedule indicator is electrically connected between the control station of the electrical operation circuit and the second time alarm means for generating and displaying an instruction indicating that maintenance is required when the second time alarm means detects that the time the electrically operated folding operable wall was last serviced has reached the second preset time for maintenance. As stated above, the second alarm means is pre-programmed by the manufacturer of the electrically operated folding operable wall, for example, to detect when the time measured by the time measuring means has reached a second preset time for maintenance, according to the manufacturers instructions, including the manufacturer's recommended service interval. Accordingly, when the time measuring means has reached a specific second preset time for maintenance, the second maintenance schedule indicator will provide an instruction indicating that maintenance is immediately required, and optionally will indicate specifically the required maintenance task (s).

Referring again to FIG. 3, in an embodiment of the present invention, the alarm signal unit 30 can function as a second maintenance schedule indicator. As discussed above, the alarm signal unit 30 can be, for example, a visual alarm signal unit and can include one or more light emitting diodes (LED), incandescent or fluorescent lights, or a visual display screen such as a cathode ray tube (CRT), a touch screen, or a liquid crystal display (LCD), and can generate a steady or flashing light, scrolling or steady text, and the like to visually alert an operator that maintenance will be required in a predetermined period of time. In another embodiment, the alarm signal unit 30 can be an audible alarm signal unit such as, for example, a buzzer, bell, steady or intermittent tone generator, verbal recording or the like.

A preventing means prevents the electrical operation circuit of the folding operable wall from functioning after the second time alarm detects that the time measuring means has reached the second preset time for maintenance. In particular, the preventing means includes at least one control unit electrically connected between each control station of the electrical operation circuit and the second time alarm means, which will prevent the control unit from functioning if the second time alarm detects that the time measuring means has reached a second preset time for maintenance.

A resetting means is electrically connected between control station 12 of the electrical operation circuit and the maintenance detecting means for resetting the time measured by the time measuring means once the maintenance detecting means detects that the required maintenance has been performed.

A restarting means restarts the electrical operation circuit of the folding operable wall after the maintenance detecting means detects that required service has been performed. In particular, the restarting means includes a reset control key switch in control unit 12, which when turned on will reactivate the electrical operation circuit.

As stated above, the maintenance detecting means detects if and when maintenance has been performed. The maintenance detecting means also removes warning indicating that maintenance is soon required, and the instruction indicating that maintenance is required, once the maintenance detecting means detects that maintenance has been performed. It is envisioned that allowing individual(s) responsible for maintaining the electrically operated folding operable walls to reset the electrically operated folding operable wall system by simply entering that maintenance has been performed, would create the potential that the system could be reset without the required maintenance having actually been performed. Accordingly, the maintenance detecting means ensures that the required maintenance is actually performed before maintenance schedule display control means removes the warning indicating that maintenance is soon required on the display means and/or the instruction indicating that maintenance is required.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A safety system for maintaining an electrically operated foldable wall having an electrical operation circuit with at least one control station, the system comprising:

(a) a maintenance detecting means for detecting whether maintenance has been performed on the electrically operated foldable wall;

(b) a time measuring means for measuring time since the electrically operated foldable wall was last serviced;

(c) a first time alarm means for detecting a first preset time for a maintenance reminder;

(d) a second time alarm means for detecting a second preset time for maintenance;

(e) a first maintenance schedule indicator for providing a maintenance reminder that maintenance is soon required;

(f) a second maintenance schedule indicator for indicating that maintenance is presently required;

(g) a preventing means for preventing the electrical operation circuit of the folding operable wall from functioning after the second time alarm detects that the time measuring means has reached the second preset time for maintenance;

(h) a resetting means for resetting the time measured by the time measuring means after the required maintenance has been performed; and (i) a restarting means for restarting the electrical operation circuit of the folding operable wall after the required service has been performed.

2. The system of claim 1 wherein the maintenance detecting means is operatively connectable to the control station.

3. The system of claim 2 wherein the maintenance detecting means includes sensors electrically connected to components of the electrically operated folding wall to which maintenance is to be performed.

4. The system of claim 3 wherein the maintenance detecting means includes a microprocessor unit and ROM and/or RAM memory.

5. The system of claim 1 wherein the time measuring means is electrically connectable between the control station and the maintenance detecting means.

6. The system of claim 1 wherein the time measuring means includes at least one clock or chronometer having mechanical and/or electrical bases.

7. The system of claim 6 wherein the time measuring means measures time based on a calendar.

8. The system of claim 1 wherein the first alarm means is electrically connectable between the control station of the electrical operation circuit and the time measuring means.

9. The system of claim 1 wherein the first alarm means is programmable to provide at least one maintenance reminder when at least one first preset time for maintenance reminder has elapsed.

10. The system of claim 9 wherein the second time alarm means is electrically connected between the control station of the electrical operation circuit and the time measuring means.

11. The system of claim 1 further including means for programming the first alarm means comprising a keypad or a touch screen operatively connected between the control station and the first alarm means.

12. The system of claim 1 wherein the first maintenance schedule indicator comprises a visual alarm signal unit and/or an audible alarm signal unit.

13. The system of claim 12 wherein the visual alarm signal unit comprises a light emitting diode, incandescent or fluorescent light, or a visual display screen including a cathode ray tube, touch screen, and/or a liquid crystal display.

14. The system of claim 1 wherein the second maintenance schedule indicator comprises a visual alarm signal unit and/or an audible alarm signal unit.

15. The system of claim 14 wherein the visual alarm signal unit comprises a light emitting diode, incandescent or fluorescent light, or a visual display screen including a cathode ray tube, touch screen, and/or a liquid crystal display.

16. The system of claim 1 wherein said first maintenance schedule indicator and/or said second maintenance schedule indicator comprises an audible alarm signal unit which includes a buzzer, bell, steady or intermittent tone generator, or a verbal recording.

17. The system of claim 1 wherein the preventing means includes at least one control unit electrically connected between each control station of the electrical operation circuit and the second time alarm means, which prevents the control unit from functioning if the second time alarm detects that the time measuring means has reached the preset time for maintenance.

18. The system of claim 1 wherein resetting means is electrically connected between the control station of the electrical operation circuit and the maintenance detecting means.

19. The system of claim 1 wherein the restarting means includes a reset control key switch in the at least one control unit, which when turned on will reactivate the electrical operation circuit.

20. An electrically operated folding operable wall controlled by at least one control panel, an extend limit switch, a stack limit switch, control relays and a motor, in which the invention being a safety system comprises:

a) a maintenance detecting means electrically connected to the control panel of the electrical operation circuit for detecting that required maintenance has been performed;

b) a time measuring means for measuring time since the electrically operated folding operable wall was last serviced, wherein the time measuring means is electrically connected between the control panel of the electrical operation circuit and the maintenance detecting means;

c) a first time alarm means for detecting that the time measured by the time measuring means has reached a first preset time for a maintenance reminder, wherein the first time alarm means is electrically connected between the control panel of the electrical operation circuit and the time measuring means;

d) a second time alarm means for detecting that the time measured by the time measuring means has reached a second preset time for maintenance, wherein the second time alarm means is electrically connected between the control panel of the electrical operation circuit and the time measuring means;

e) a first maintenance schedule indicator electrically connected between the control panel of the electrical operation circuit and the first time alarm means for generating and displaying a warning indicating that maintenance is soon required on a display means when the first time alarm means detects that the time the electrically operated folding operable wall was last serviced has reached the preset time for a maintenance reminder;

f) a second maintenance schedule indicator electrically connected between the control panel of the electrical operation circuit and the second time alarm means for generating and displaying an instruction indicating that maintenance is required on the display means when the second time alarm means detects that the time the electrically operated folding operable wall was last serviced has reached the preset time for maintenance;

g) a preventing means for preventing the electrical operation circuit of the folding operable wall from functioning after the second time alarm detects that the time measuring means has reached the preset time for maintenance, wherein the preventing means includes at least one control unit electrically connected between each control panel of the electrical operation circuit and the second time alarm means, which will prevent the control unit from functioning if the second time alarm detects that the time measuring means has reached the preset time for maintenance;

h) a resetting means electrically connected between the control panel of the electrical operation circuit and the maintenance detecting means for resetting the time measured by the time measuring means, when the maintenance detecting means detects that the required maintenance has been performed; and i) a restarting means for restarting the electrical operation circuit of the folding operable wall after the maintenance detecting means detects that required service has been performed, wherein the restarting means includes a reset control key switch in the at least one control unit, which when turned on will reactivate the electrical operation circuit.

* * * * *